United States Patent [19]

Blackstone

[11] 4,207,858

[45] Jun. 17, 1980

[54] COMPOUND BOW

[76] Inventor: Robert L. Blackstone, 1912 Country Club Rd., Hendersonville, N.C. 28739

[21] Appl. No.: 893,457

[22] Filed: Apr. 4, 1978

[51] Int. Cl.[2] ..... F41B 5/00

[52] U.S. Cl. ..... 124/23 R; 124/88; 124/90

[58] Field of Search ..... 124/23 R, 24 R, 88, 124/90, 41 A, 86

[56] References Cited

U.S. PATENT DOCUMENTS

| | | | |
|---|---|---|---|
| 3,923,035 | 12/1975 | Trotter | 124/24 R |
| 3,967,609 | 7/1976 | Frydenlund | 124/24 R |
| 4,064,862 | 12/1977 | Groner | 124/23 R |

*Primary Examiner*—William R. Browne

*Attorney, Agent, or Firm*—Bailey, Dority & Flint

[57] ABSTRACT

A compound bow having a handle and flexing limbs extending outwardly from the handle. A bracket is carried adjacent a medial portion of the handle and a pair of arms are pivotally secured thereto. The arms diverge rearwardly from the bracket. A string engaging member is carried adjacent the outer ends of each of the arms. A pair of pulleys are carried adjacent each remote end of the limbs. A bow string has opposed ends thereof attached to a respective inner end of a respective arm. The string extends around the pulleys on the ends of the limbs and the string engaging members so that when a notching portion of the string is drawn for shooting an arrow, the pivotal arms are pivoted from an open extended position to a partially closed position providing a uniform draw of the string when drawing the string from a released position to a fully drawn position. A pair of eccentric cams are carried adjacent the arms over which respective opposed end portions of the string extends. These eccentric cams are pivotally mounted so that when the string is pulled to the fully drawn position, the cams are pivoted, minimizing or steadying the holding force required for holding the string.

4 Claims, 8 Drawing Figures

COMPOUND BOW

BACKGROUND OF THE INVENTION

Compound bows are well known and many of them have eccentrically mounted pulleys over which the string passes for minimizing the force required to hold the string in a fully drawn position. While these eccentric type bows do, in fact, reduce the force required for holding the bow in the fully drawn position, this adversely affects the carry through force of the bow. In conventional eccentric bows there is a loss in the carry-through thrust or force as a result of the eccentrics.

In the conventional recurved bow, while it is very efficient from the standpoint of letoff loss, one major problem is that the pulling force required from drawing the string from a release position to a fully drawn position is not uniform.

Examples of compound bows are disclosed in U.S. Pat. Nos. 3,967,609, 3,993,039, 3,854,467, 3,987,777 and 3,923,035.

SUMMARY OF THE INVENTION

The invention relates to a compound bow having a handle with flexing limbs extending outwardly therefrom. A bracket is carried by a medial portion of the handle and a pair of arms is pivotally attached to the bracket. The arms diverge rearwardly from the bracket and a pulley acting as a string engaging member is carried adjacent the outer end of each of the arms. A pair of pulleys are also carried adjacent each remote end of the limbs. Opposed ends of a bow string are attached to inner ends of respective arms and extend around cams, the string engaging members, and the pulleys carried on the remote end of the limbs so that when the string is fully drawn the pivotal arms are pivoted from an open extended position to a partially closed position. As a result, a uniform pulling force is required for drawing the string from the release position to the fully drawn position. Also, when the string is in the fully drawn position it appears to be much easier to hold this position than is the case with conventional compound and recurve bows.

Accordingly, it is an important object of the present invention to provide a compound bow which has a substantially uniform draw from a release position to the fully drawn position.

Another important object of the present invention is to provide a compound bow which utilizes cam members for aiding in minimizing the force required for holding the bow in a fully drawn position without adversely affecting the letoff thrust when comparing this bow with a bow which utilizes eccentrics.

Still another important object of the present invention is to provide a simple and efficient compound bow even at low pull rates weights, i.e., 20 pounds and overall lengths as short as 38 inches.

These and other objects and advantages of the invention will become apparent upon reference to the following specification, attendant claims, and drawings.

DESCRIPTION OF A PREFERRED EMBODIMENT

Figures 1, 2, 2A, 2B:
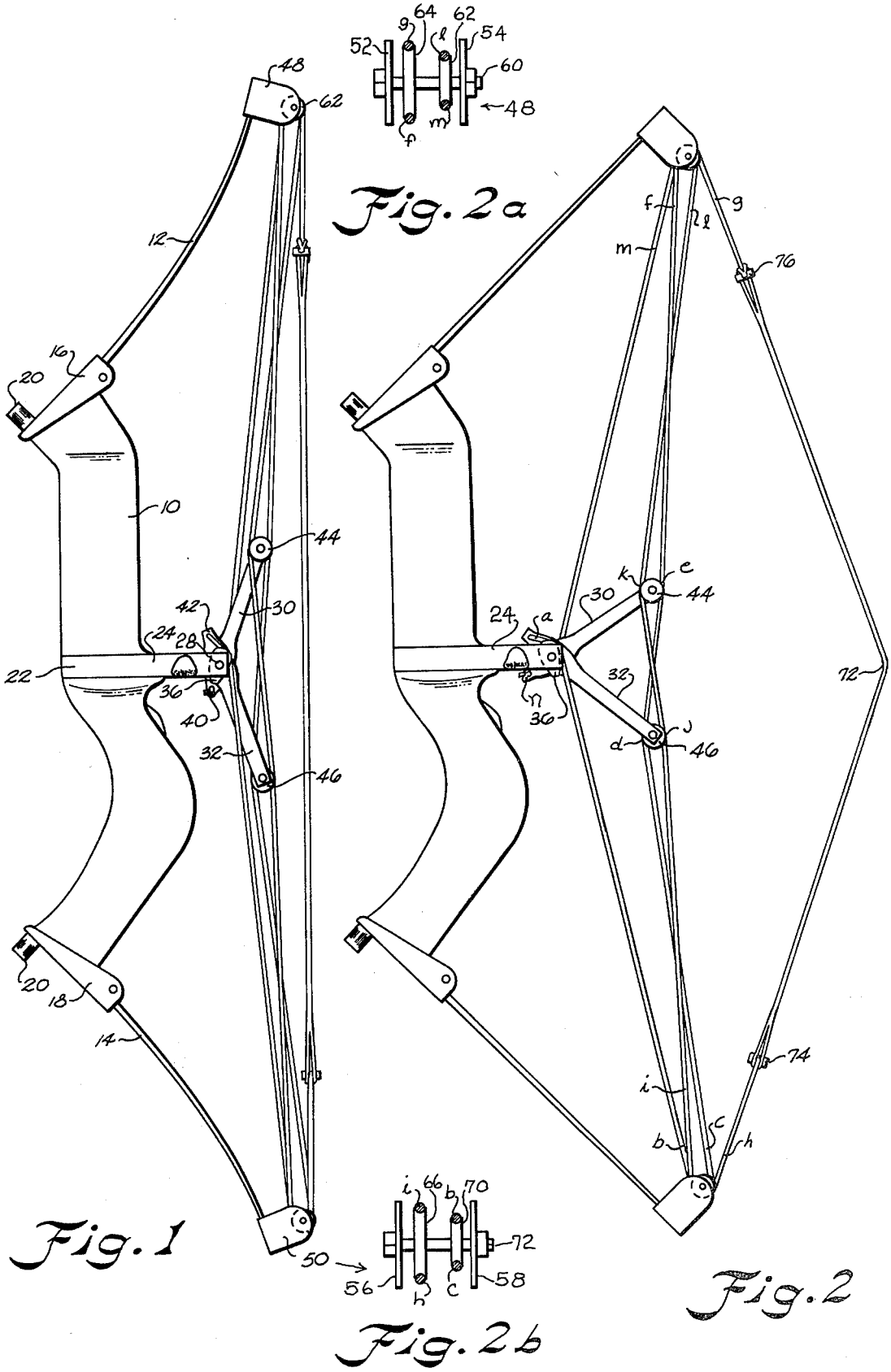
FIG. 1 is a side elevational view of a compound bow constructed in accordance with the present invention shown in a released position.
FIG. 2 is a side elevational view of the same bow in a fully drawn position, FIGS. *2a* and *2b* are enlarged end views illustrating the pulleys carried on remote ends of the limbs of the bow.

Referring in more detail to FIG. 1 of the drawings, there is illustrated a compound bow constructed in accordance with the present invention having a conventional handle 10 with flexing limbs 12 and 14 extending outwardly therefrom. The inner ends of the limbs 12 and 14 are attached to the handle by means of brackets 16 and 18 which are secured by bolts 20 to the handle.

A bracket 22 is carried adjacent a medial portion of the handle and includes a pair of laterally spaced rearwardly extending plates 24 and 26.

Extending through these plates 24 and 26 is a bolt 28 upon which arms 30 and 32 and cams 34 and 36 are pivotally carried.

The arms 30 and 32 have holes extending through an inner end thereof through which the ends 40 and 42 of the string pass and are knotted for securing the string thereto.

Positioned on the outer ends of the arms 30 and 32 are grooved rollers 44 and 46. These rollers are rotatably mounted on the outer ends of the arms. As seen in FIG. 1 of the drawings, the arms 30 and 32 diverge rearwardly to a substantially open position when the bow is in the release position as illustrated in FIG. 1. They are permitted to pivot to a substantially closed position, such as illustrated in FIG. 2 when the bow is fully drawn.

Positioned on the remote ends of the limbs 12 and 14 are brackets 48 and 50 which include spaced side walls 52 and 54 and 56 and 58, respectively. Extending through the spaced side walls 52 and 54 is a bolt 60 in which pulleys 62 and 64 are carried. The pulleys 62 and 64 are associated with the bracket 48. Similar pulleys 66 and 70 are carried on a bolt 72 extending between the side walls 56 and 58 of the bracket 50.

In tracing the path of a string (see FIG. 2) for the bow from end 42 to end 40 the reference characters a through n will be utilized to show the path of the string around the pulleys and other components. Beginning with the end labeled a the string extends around cam 36 and passes under and around roller 70, exits at reference character c, back to the inside of roller 46 carried on arm 32 as identified by reference character d, to the rear side of roller 44 as identified by reference character e, around roller 64 entering as f and exiting as g back across the bow for forming a string notching portion 72 in which the arrow is notched over and around roller 66 as identified by the reference characters h and l, to the rear side of roller 46 as identified by reference character j, to the forward side of roller 44 as identified by the reference character k, over and around the roller 62 as identified by the reference characters l and m, back down and around cam 34 and tied to the inner end of arm 30 as indicated by the reference character n.

The string includes a notching portion 72 which is secured therein by any suitable conventional fasteners such as illustrated at 74 and 76. Normally, the portion of the string in which the end of the arrow is notched is constructed differently from the remainder of the string. The cams 34 and 36 have a substantially right-angle corner as indicated by the reference character 74 over which an end portion of the string passes. It also has a substantially straight surface as indicated by the reference character 76. When the string is drawn to the full drawn position such as illustrated in FIGS. 2 and 4, the substantially straight portion 76 of the cam is substantially in alignment with the pulleys carried on the remote end of the bows.

Figure 3:
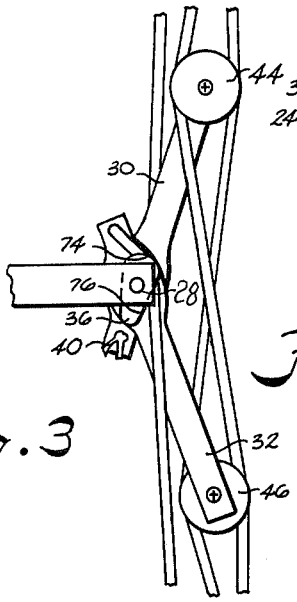
FIG. 3 is an enlarged elevational view illustrating the position of the arms and cams when the bow string is in a released position.
Figure 5:
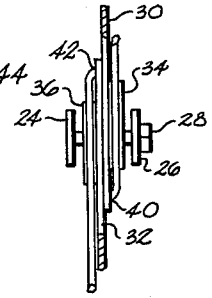
FIG. 5 is a fragmentary end view looking into the bow from the rear.
Figure 4:
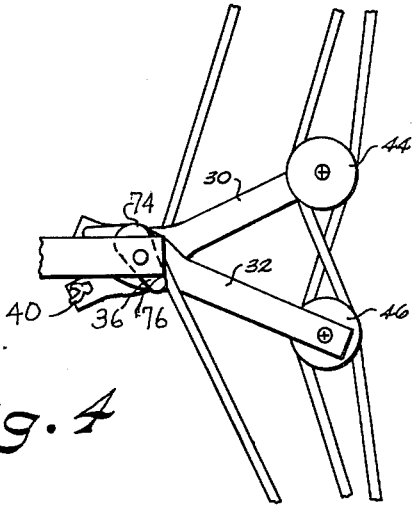
FIG. 4 illustrates the position of the pivotal arms and cam member when the bow is in a fully drawn position.

While it is not certain exactly why it is easier to hold the string in a full drawn position, it is thought that this results from the action of the cams 34 and 36 and to the fact that the ends of the string move as the bow is drawn from a fully released position such as illustrated in FIG. 3, to a fully drawn position such as illustrated in FIG. 4.

As a result of the ends of the strings being tied adjacent the center of the bow and extending around pulleys and compared to eccentrics, a reference point on the string is maintained constant and there is no slippage of the string. In other words, the arrow is notched in the same position on the string each and every time an arrow is shot.

As a result of the pulleys 44 and 46 being pivotable on the ends of the pivotable arms 30 and 32, it minimizes the friction in the system resulting in less force for drawing the bow.

Figure 6:
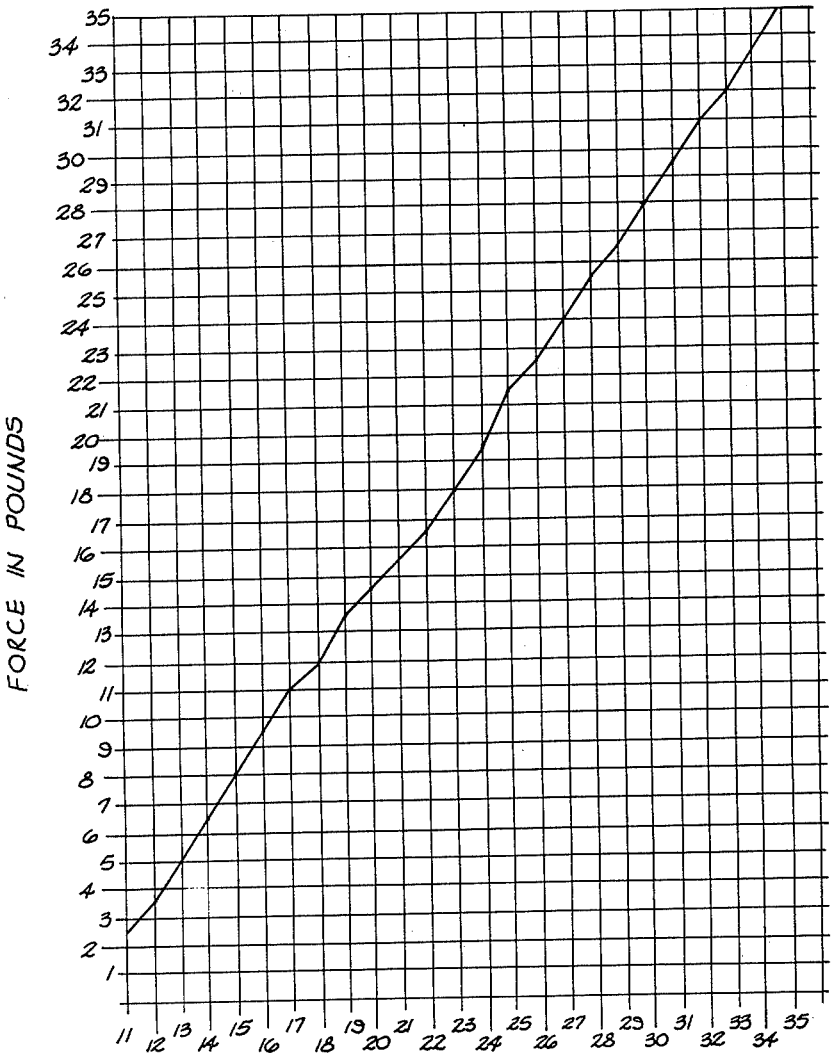
FIG. 6 is a chart illustrating the draw force required for the bow.

FIG. 6 is a chart illustrating the pounds of force required for drawing the string a certain number of inches. As can be seen from FIG. 6, the draw force required is substantially uniform from a fully released position to a fully drawn position. As illustrated, when the bow is fully drawn the string is pulled thirty-five inches requiring approximately thirty-five pounds of force.

While a preferred embodiment of the invention has been described using specific terms, such description is for illustrative purposes only, and it is to be understood that changes and variations may be made without departing from the spirit or scope of the following claims.

What is claimed is:

1. In a compound bow having a handle portion and flexing limbs extending outwardly from the handle portion, the improvement comprising:

a pair of bow limbs;

a bracket carried by a medial portion of handle portion and extending rearwardly therefrom;

a pair of arms being pivotally attached adjacent inner ends thereof to a said rearwardly extending bracket;

said pair of arms diverging rearwardly from said bracket, a string engaging member carried adjacent an outer end of each of said arms, a pair of pulleys carried adjacent each remote end of said limbs;

a bow string having one end attached to said inner end of one of said arms and being trained around one of said pulleys on a remote end of one of said limbs back around a forward side of a string engaging member carried on one of said arms, around a rear side of said string engaging member carried by said other arm, around one of said pulleys on a remote end of the other said limb, back across said limbs, around the other pulley carried on a remote end of said one of said limbs, around a rear side of said string engaging member carried on said one of said arms, around the forward side of said string engaging member carried by said other arm, around the other pulley carried by a remote end of said other limb, and having the other end attached to said inner end of said other of said arm;

the portion of said string extending between said one of said pulleys of said other limb and said other pulley of said one of said limbs containing a notching zone for an arrow.

2. In a compound bow having a handle and flexing limbs extending outwardly from the handle, the improvement comprising:

a pair of bow limbs; a bow handle;

a bracket carried by a medial portion of said handle;

a pair of arms pivotally attached at their inner ends to said bracket;

said arms diverging rearwardly from said bracket;

a string engaging member carried adjacent an outer end of each of said arms;

a pair of pulleys carried adjacent each remote end of said limbs;

a bow string having opposed ends thereof attached directly to a respective said inner end of a respective arm;

means for stringing said bow string around said pulleys on the ends of said limbs and said string engaging members so that when a nocking portion of said string is drawn for shooting an arrow, said pivotal arms are pivoted in a scissor action from an opened extended position to a partially closed position providing a uniform draw of said string when drawing said string from a release position to a fully drawn position.

3. The compound bow as set forth in claim 2 further comprising:

a pair of eccentric cams carried adjacent said arms over which respective end portions of said string extends;

means for pivotally mounting said cams so that when said string is pulled to the fully drawn position said cams are pivoted minimizing the holding force required for holding said string in a fully drawn position.

4. The compound bow as set forth in claim 3 further comprising:

each of said cams having a rounded substantially right angle surface which terminates in a substantially straight portion;

said string extending over said substantially right angle surface and said straight portion when said string is fully drawn with said straight portions being in line with a respective pair of pulleys carried on the end of said limbs;

thereby minimizing the effort to hold said bow in a fully drawn position.

* * * * *